US008359121B2

(12) United States Patent
Moshe et al.

(10) Patent No.: US 8,359,121 B2
(45) Date of Patent: Jan. 22, 2013

(54) SYSTEMS, METHODS AND PRODUCTS FOR SHIPPING PASSENGER/INDIVIDUAL BELONGINGS FOR TRAVEL

(76) Inventors: Sarah L. Moshe, Indianapolis, IN (US); Judith N. Stimson, Indianapolis, IN (US); Beth W. McIntire, legal representative, Indianapolis, IN (US)

( * ) Notice: Subject to any disclaimer, the term of this patent is extended or adjusted under 35 U.S.C. 154(b) by 408 days.

(21) Appl. No.: 11/866,821

(22) Filed: Oct. 3, 2007

(65) Prior Publication Data

US 2008/0188979 A1 Aug. 7, 2008

Related U.S. Application Data

(60) Provisional application No. 60/849,031, filed on Oct. 3, 2006.

(51) Int. Cl.
*G06F 7/00* (2006.01)
*G06Q 10/00* (2006.01)

(52) U.S. Cl. ..... 700/229; 700/226; 700/213; 700/225; 705/5; 705/28

(58) Field of Classification Search ..... None
See application file for complete search history.

(56) References Cited

U.S. PATENT DOCUMENTS

| | | | | |
|---|---|---|---|---|
| 6,250,544 | B1 * | 6/2001 | Chen | 229/198 |
| 6,845,293 | B1 * | 1/2005 | Ananda | 700/226 |
| 7,096,089 | B2 * | 8/2006 | Quackenbush et al. | 700/226 |
| 2004/0129039 | A1 * | 7/2004 | Reetz et al. | 70/63 |

OTHER PUBLICATIONS

UPS website, UPS Business Solutions; https://www.ups.com/uis/guest?loc=en_US.*

LuggageForward-Door to Door Luggage Delivery Service: Company; How Does It Work, Copyright 2005, @http://www.luggageforward.com/company, Founded 2004.*

Luggage Express—Affordable Luggage Shipping and Delivery Service, Copyright 2002-2009, @http://www.myluggageexpress.com/.*

UPS Offering Alternative for Luggage-Toring Air Passengers, By Karen Libby, Updated Jul. 6, 2010, @http://ozarksfirst.com/fulltext/?nxd_id=291005.*

* cited by examiner

*Primary Examiner* — Gene Crawford
*Assistant Examiner* — Yolanda Jones
(74) *Attorney, Agent, or Firm* — Woodard Emhardt Moriarty McNett & Henry, LLP

(57) ABSTRACT

Described are systems, methods and products for the shipment of passenger or other traveler containers, e.g. containing personal items for use during travel. In certain aspects, systems and methods for such shipment involve the use of transport vessels other than those that will be occupied by a passenger during travel, e.g. cargo vessels or vehicles.

16 Claims, 4 Drawing Sheets

SYSTEMS, METHODS AND PRODUCTS FOR SHIPPING PASSENGER/INDIVIDUAL BELONGINGS FOR TRAVEL

REFERENCE TO RELATED APPLICATION

The present application claims the benefit of U.S. Provisional Patent Application Ser. No. 60/849,031 filed Oct. 3, 2006 entitled SYSTEMS, METHODS AND PRODUCTS FOR SHIPPING PASSENGER/INDIVIDUAL LUGGAGE FOR TRAVEL, which is hereby incorporated by reference in its entirety.

BACKGROUND

The present invention relates generally to travel, and in certain embodiments to systems, methods, and products which facilitate the ability of a traveler to ship, rather than carry, luggage and/or other belongings from an origin to a destination and back.

As further background, it is conventional for travelers to carry their luggage with them to the airport, train station, etc., and to have that luggage travel with them on the transport vessel to their destination. Similarly, on the return trip, it is conventional for travelers and their luggage to travel on the same transport vessel back to their point of origin. In connection with these activities, travelers must transport their luggage through airports or train stations, during transfers, to cars or buses, and to their final destinations. Often times, these efforts have associated waiting lines (and ever more restrictive security measures) and charges for tipping, carts or otherwise. Travelers with small children or disabilities face additional difficulties. As well, these activities complicate the business necessarily conducted by the transport vessel.

Accordingly, needs exist for improved and/or alternative systems, methods and products related to the transportation of belongings for travelers from their point of origin, to their destination, and back. The present invention is addressed to these needs.

SUMMARY

In certain aspects, the invention relates to shipping systems and methods for travelers that are designed to obviate the need to handle luggage in airports, during transfers, etc. Containers containing the belongings of a traveler can be picked up and transported by a shipper to and from the traveler's origin and destination.

In one embodiment, provided is a method for arranging for transportation of containers of an airline passenger from an origin location to a destination location via a flight taken from an origin airport to a destination airport, the origin location and destination location being distinct from the origin airport and the origin location, respectively. The method comprises:

(a) entering origin location information, passenger airline flight information, destination location information, and container information for the passenger into a database;
(b) arranging for collection of the container at the origin location;
(c) arranging for transport of the container to the origin airport;
(d) arranging for air transport of the container to the destination airport on a non-passenger (or cargo) flight; and
(e) arranging for ground transport of the container from the destination airport to the destination location.

The method of this embodiment can also comprise one or more additional steps as described herein. Illustratively, in certain embodiments, the method also comprises maintaining updated information concerning container location and delivery status in a database, and potentially also making that updated information available to the passenger via internet or telephone tracking. Additionally, corresponding embodiments are provided wherein the passenger is a traveler on a commercial passenger vessel other than an airplane, e.g. a train, car, boat, etc. In such cases, separate shipment of the traveler's containers can be made on similar or differing transport vehicles (e.g. train vs. plane, etc.).

In another embodiment, provided is a method for arranging for transportation of containers of an airline passenger from an origin location to a destination location via a flight taken from an origin airport to a destination airport, the origin location and destination location being distinct from the origin airport and the origin location, respectively. The method of this embodiment comprises:

(a) entering origin location information, destination location information, container information, original shipping date information, and return shipping date information for the passenger into a database;
(b) arranging for collection of the container at the origin location on the original shipping date;
(c) arranging for transport of the container to the origin airport after collection at the origin location;
(d) arranging for air transport of the container to the destination airport on a non-passenger flight;
(e) arranging for ground transport of the container from the destination airport to the destination location;
(f) arranging for collection of the container at the destination location on the return shipping date;
(g) arranging for ground transport of the container from the destination location to the destination airport after collection on the return shipping date;
(h) arranging for air transport of the container to the origin airport from the destination airport on a non-passenger or cargo flight; and
(i) arranging for transport of the container from the origin airport to the origin location.

The method of this embodiment can also comprise one or more additional steps as described herein. Additionally, corresponding embodiments are provided wherein the passenger is a traveler on a commercial passenger vessel other than an airplane, e.g. a train, car, boat, etc. In such cases, separate shipment of the traveler's containers can be made on similar or differing transport vehicles (e.g. train vs. plane, etc.).

In another embodiment, provided is a method for arranging for shipment of container of an individual from the individual's origin location to the individual's destination location, and back. This method comprises:

(a) entering the individual's origin location information, the individual's destination location information, container information, original shipping date information, and return shipping date information for the individual into a database;
(b) arranging for collection of the container at the individual's origin location on the original shipping date;
(c) arranging for transport of the container to the individual's destination location;
(d) arranging for collection of the container at the individual's destination location on the return shipping date; and
(e) arranging for transport of the container from the individual's destination location to the individual's origin location.

More specific embodiments of this method include one or more additional features as described herein.

In another embodiment, provided is an article of manufacture for shipment of personal belongings of an individual. The article can include a container made with paperboard or other similar material and visible indicia carried upon an external surface of the container simulating, for example the appearance of a luggage bag such as a suitcase. The visible indicia can include at least one image simulating the appearance of a luggage bag handle, a luggage bag latch, a luggage bag zipper, a luggage bag surface texture such as simulated leather or textile features, and/or a luggage bag seam. These visible indicia can, for example, serve as markings to distinguish passenger luggage items to be shipped from other items to be shipped. In addition or alternatively, such visible indicia can serve to mark a desired orientation of the container during shipping.

In still further embodiments, the present invention provides systems for arranging for transportation of containers of an airline passenger from an origin location to a destination location via a flight taken from an origin airport to a destination airport, the origin location and destination location being distinct from the origin airport and the origin location, respectively. The systems are equipped with computer processors and databases for facilitating and/or carrying out methods as described above and elsewhere herein.

These and further embodiments of the invention, as well as their advantages and features, will be apparent from the descriptions herein.

DETAILED DESCRIPTION

For the purpose of promoting an understanding of the principles of the invention, reference will now be made to certain embodiments thereof and specific language will be used to describe the same. It will nevertheless be understood that no limitation of the scope of the invention is thereby intended. Any alterations and further modifications in the described embodiments, and any further applications of the principles of the invention as described herein, are contemplated as would normally occur to one skilled in the art to which the invention relates.

As noted above, aspects of the present invention relate to methods, systems, and products for facilitating the shipment of belongings of an airline passenger to the passenger's destination, and then back to the passenger's point of origin. It will be understood that multiple novel combinations of system elements, method steps, and product features, or combinations of these, are described in the present document. Each of these novel combinations is contemplated as being a part of the inventions described herein.

In a first aspect, provided is a specially-manufactured container that will be sufficiently durable to be shipped containing belongings, such as clothing and personal items of the passenger, to the passenger's destination. The container will bear printed visible indicia on an external surface thereof, with the indicia simulating one or more features of conventional luggage bags, such as handle(s), latch(es), zipper(s), seam(s), texture(s) such as leather or textile. These visible indicia can serve to identify and distinguish the passenger's luggage containers from other containers, perhaps being shipped by the same shipping company or organization. The container is beneficially fabricated from paperboard or similar material and preferably also collapsible to a relatively flattened state so that it can stored on a shelf or under a bed when unpacked (e.g. at the passenger's home or other point of origin and/or at the passenger's destination). Preferred containers will also be easy to re-assemble for repacking and return shipping. In carrying out methods of the invention, such containers can be provided in a variety of sizes and design variations. Illustratively, smaller containers can be available to accommodate short trips, whereas larger containers can be included to accommodate needs for belongings during extended travel. As well, special needs containers can be provided including relatively elongated containers adapted to contain and ship golf clubs, skis, and the like. As well, specialized containers can be provided for shipping strollers, car seats, or other common traveler needs. In each case, the containers can meet or exceed safe shipping standards, and may optionally be reusable, or can be designed for one-time use.

Figure 1:
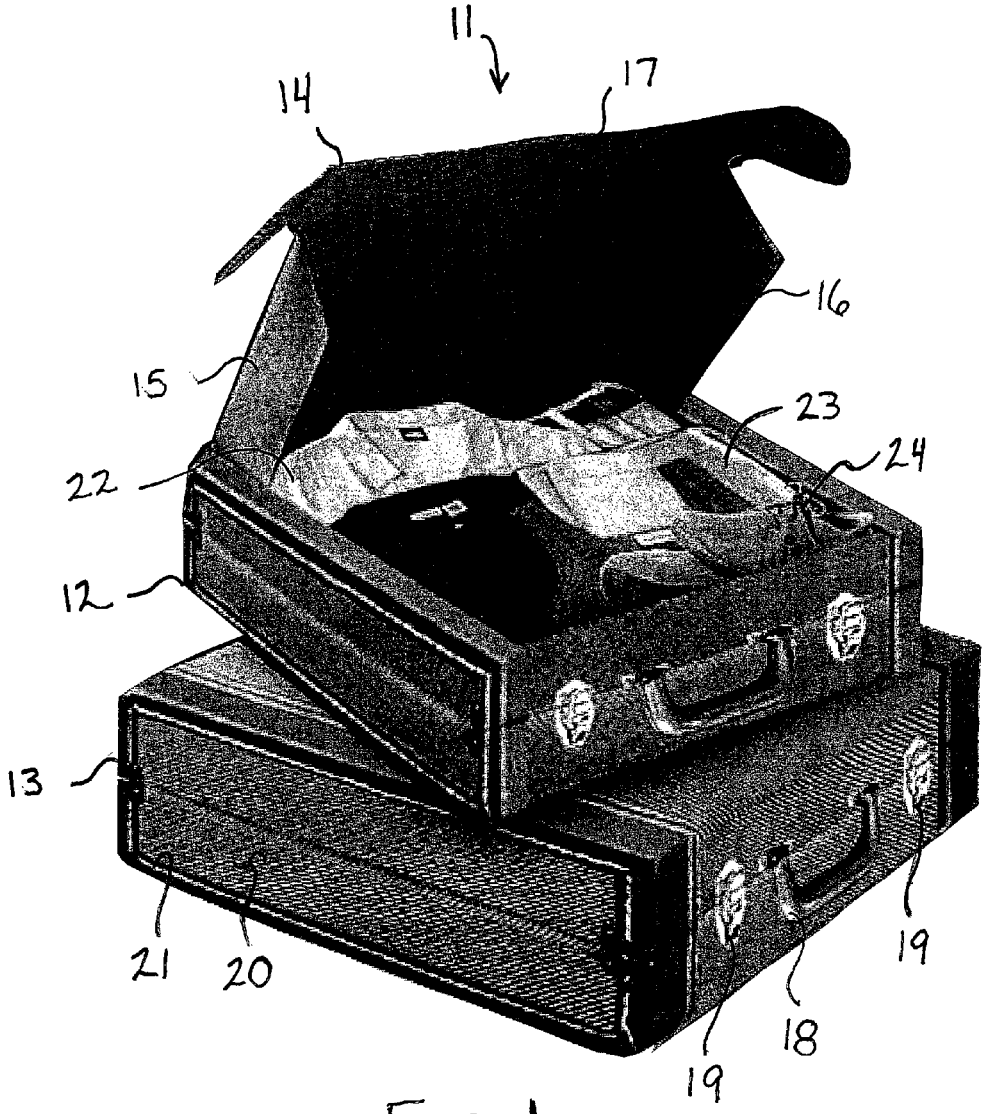
FIG. 1 provides a perspective view of certain specially-designed containers for shipping belongings of a passenger.

With reference now to FIG. 1, shown is a first set 11 of shipping containers in accordance with one embodiment of the invention. Set 11 includes a first, smaller container 12 made from paperboard or similar material, and a second, larger container 13 made from paperboard, both similar in design and appearance except differing in size. Illustratively, container 12 includes a lid portion 14 having sidewalls 15 and 16 folded down therefrom and adapted to slide into the lower cavity defined by container 12. Lid portion 14 also includes a front flap 17 designed to slide and tuck within the front portions of the cavity defined container 12. Container 12 and container 13 can include visual features on their external surfaces consistent with the appearance of conventional luggage. Thus, containers 12 and 13 include an image of a handle 18, and images of latching devices 19. The images of the handle 18 and latches 19 can appear on the same side face of the containers 12 and 13, as occurs in conventional luggage in most cases. As well, containers 12 and 13 carry external images 20 giving the appearance of a textured surface, such as a fabric, cloth, or leather surface. Still further, containers 12 and 13 can include one or more image features 21 that simulate the appearance of a sewn seam as might occur in conventional luggage. Containers 12 and 13 can be designed to carry belongings of a traveler such as shirts 22, pant 23, shoes 24, or other personal items. In this regard, containers 12 and 13 will have sufficient capacity and will be sufficiently durable to ship the illustrated or other types of belongings of the passenger.

Figure 2:
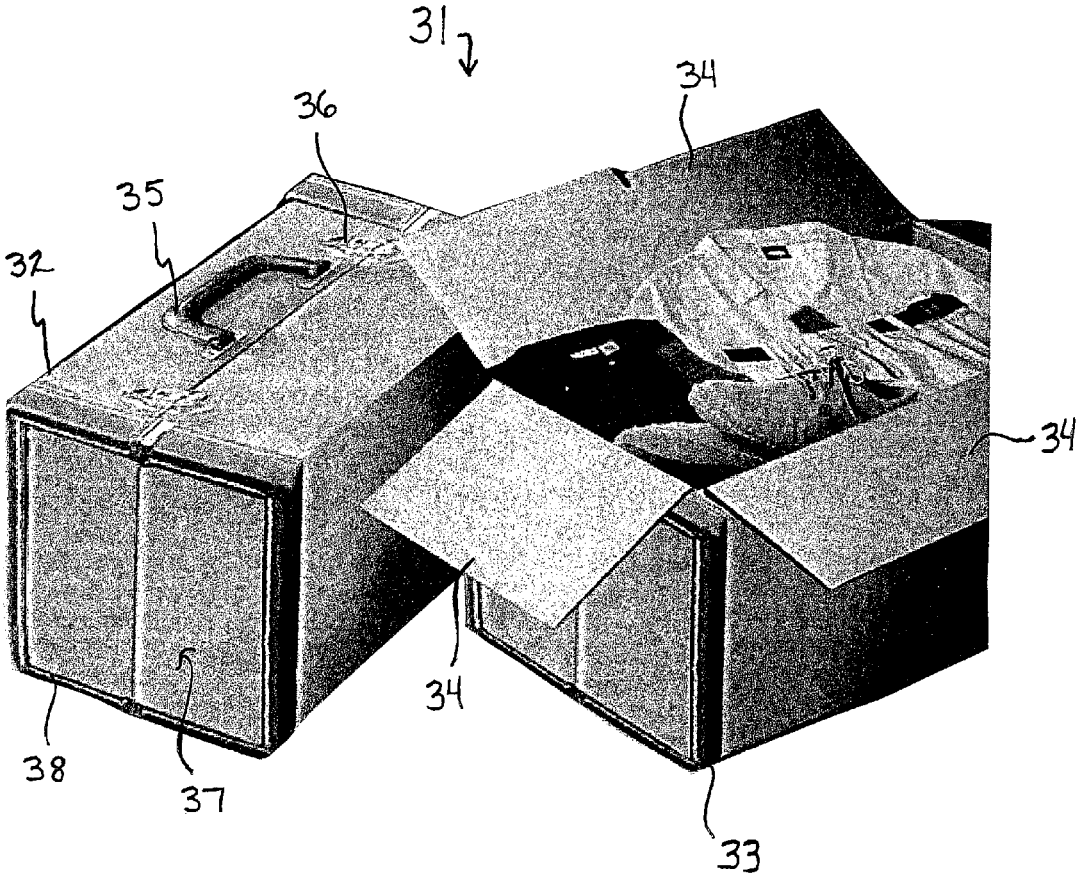
FIG. 2 provides a perspective view of alternative containers that can be used for shipping belongings of a passenger.

Referring now to FIG. 2, shown is an additional or alternative set 31 of paperboard containers for shipping a passenger's belongings for travel purposes. Set 31 includes containers 32 and 33 which have dimensions more similar to a deep and wide conventional luggage chest that might be used carry a passenger's belongings. Illustratively, container 33 includes upper flaps 34 forming a lid for the container 33, which can be closed and sealed during shipment. Containers 32 and 33 also carry external visible indicia consistent with conventional luggage. Thus, these containers include images of handles 35, latches 36, textures 37, and/or seams 38, generally as also described in connection with FIG. 1 above.

With continuing reference to FIGS. 1 and 2, in preferred forms, the containers 12, 13, 32, and 33 are of such a design that they can be manually disassembled or unfolded to provide a relatively flattened configuration for storage, and then re-assembled to provide the voluminous container configuration. This may, for example, be similar to foldable/unfoldable "banker's boxes" as are presently in use. In such embodiments, multiple flaps can be provided which contact and potentially interleave with one another to provide a stable, three-dimensional container structure. On the other hand, this contact and/or interleaving can be manually undone to render the containers to a relatively flattened configuration.

Figure 3:
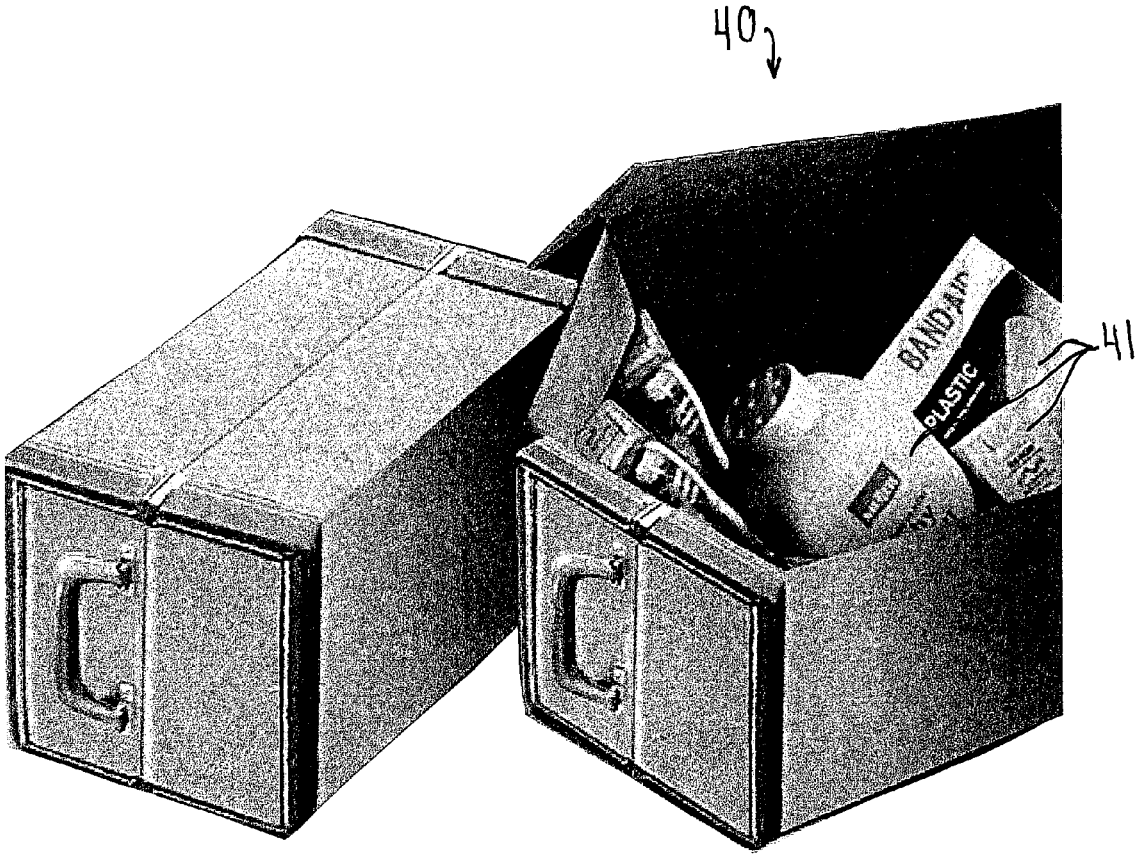
FIG. 3 provides a perspective view of a pre-packaged carry-on container (right) in accordance with one embodiment of the invention.

In an additional aspect, methods, systems or products of the invention can involve the provision of a carry-on container 40 (see FIG. 3, right), which can be a smaller version of specially-manufactured containers as shows in FIGS. 1 and 2. The carry-on container 40 can be pre-manufactured as a kit containing a plurality of travel convenience items 41 such as ear plugs, travel socks, eye masks, mints, toothbrushes, toothpaste or tooth powder, a hair brush and/or comb, a disposable razor, lip balm and the like. Any and all such items prepackaged in the kit can be pre-approved by the Transportation Security Administration of the United States or another body regulating shipment or travel. Carry-on kits can be provided and made available to passengers in various designs such as a children's design, a masculine design, and/or a feminine design. Illustratively, the children's kit might include crayons and a coloring pad, a puzzle, or another entertainment article. Carry-on kits as disclosed herein may be used as promotional items to attract travelers to the method or system provided, can be offered for a charge, or can be an element of the overall system or service.

Figure 4:
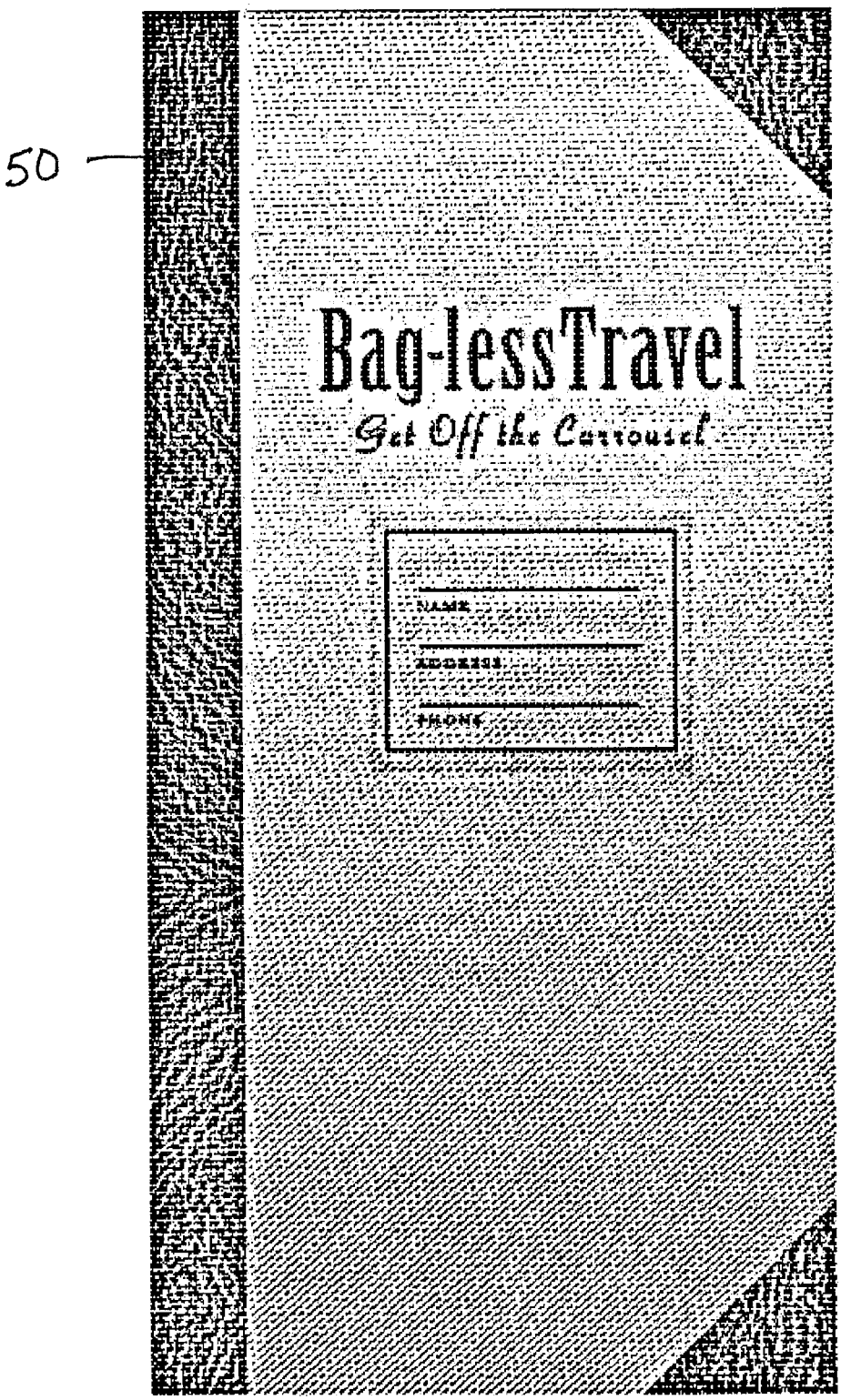
FIG. 4 provides an illustration of an external appearance of one embodiment of a pamphlet of the invention.

Container shipment systems or methods of the invention can also be accompanied by an information pamphlet containing information useful to a consumer of the system or method. Illustratively, the pamphlet can be fabricated from paper but carry visible indicia providing a simulated surface texture such as leather, e.g., a simulated leather travel wallet (see e.g. illustrative pamphlet 50, FIG. 4), with spaces provided therein to store tickets, identification documents, claim checks, or other travel-related items. The pamphlet can, for example, include written information addressing some or all of the following:

1. Introduction to the Container Shipment Method/System
2. Determining Your Needs/Costs
3. Contacting Your Local Shipper
4. Packing Efficiently
   i. Carbon-copy checklists so traveler can ship a copy with his belongings and carry a copy
   ii. Domestic/International checklists, Hot/Cold Climate checklists, etc.
5. Preparing Labels and Claim Checks
6. Insuring Your Belongings
   i. General Information
   ii. Claims Procedure
   iii. Immediate disbursement upon arrival at destination if container has not arrived (rather than reimbursement after return to origin)
7. Setting Up Safeguards
8. Verifying Airline Carry-On Regulations
9. Scheduling Pick-Up, Delivery and Return
   i. On-line forms
   ii. Telephone access
10. Tracking and Troubleshooting
11. Notifying the Hotel, Condominium, Cruiseline, Campsite, etc.
12. Helpful Hints Labels and claim checks can be provided with the containers to be used to ship the passenger's belongings. The labels can be pre-addressed, one with the destination address for delivery, and another with the origin address for return shipping. The labels can be provided as stickers to be applied to the containers. The labels can also carry a bar-code or other coding element, which can be used to help identify and track the containers.

In certain of its embodiments, the present invention provides systems and methods for arranging for the transport and/or transporting belongings of a traveler, and methods of doing business for the same. Such systems can include means for acquiring and storing traveler/customer information, as well as means for transmitting information to a traveler/customer. For example, this system can include one or more electronic databases and one or more computer processors supporting customer/traveler interfaces. In addition or alternatively, customer/traveler interfaces can be provided by staff who can communicate with the customer/traveler verbally and/or in writing. Illustratively, the maintained database may include the customer/traveler name, travel dates including departure and return dates, shipping dates for belongings including original and return shipping dates, the customer/traveler origin address, the customer/traveler destination address, and customer/traveler flight information such as the airline(s) or other transport vessel being used, flight or other transport identifiers such as flight or other transport numbers, any co-travelers, and the like. Customer/traveler interfaces such as web-based customer interfaces can be provided for entry of this information. Alternatively, a representative of the company providing the shipment service can verbally interface with the customer and enter this information into the database. In additional embodiments, customer/passenger interfaces in the system can include the potential for the customer/traveler to make payment for the services provided, including, for example, credit card payment. This may be provided in the fashion of an Internet web interface or other communications network interface that is secure and allows for credit card payment for the services. As well, a web interface for customer/passenger can provide on-line information to attract and educate customers/travelers to the service and system. Still further, the web interface or other customer/passenger interface can provide means for notifying the customer/traveler of certain events or capacities. Illustratively, the interface can have means for notifying the customer/traveler whether the associated shipping service provider has capacity to meet the customer/traveler's request for shipping, and/or for confirmation of customer/traveler's engagement of the services. As well, the notification aspects of the interface can optionally include provision of a customer/traveler waiting list in the event that the capacity of the service provider is full at the initial contact from the customer/traveler, but the customer/traveler wishes to be notified if capacity becomes available to accept the customer/traveler's request, e.g. due to cancellations, increases in overall capacity, etc.

Upon engagement of the shipper's services, the customer/traveler will need to acquire the appropriate containers and/or labels for shipping the belongings of the customer/traveler. In one aspect, the appropriate containers (e.g., as chosen by the customer/traveler on a web or other customer interface) can be shipped to the customer/traveler by the service provider. In addition or alternatively, the containers can be purchased or picked up at dispersed locations within the community, including at established commercial businesses or such as shippers, office supply outlets and others. In certain aspects, the containers used for shipping can be specially designed containers such as those described above, e.g. in connection with FIGS. 1, 2 and/or 3.

Upon obtaining the containers, the customer/traveler can pack the containers with the belongings desired for the travel. The customer/traveler can then contact the service provider to arrange for pickup of the containers, or the customer/traveler can drop off the containers at a site provided by or otherwise associated with the shipping service provider. Contact with the service provider can, for example, be made by phone, e-mail, or web interface. The shipping service provider can then confirm the request for pickup and the time for pickup by similar means, e.g., phone, e-mail, or customer web interface/notification. The service provider can then send a representative to pick up the containers from the location requested by the customer/traveler, whereupon the containers can be scanned for identification by the service provider representative. The scanned information can be taken from a barcode or other coding element on the containers. The scanned information can include items such as the date, time, and place of pickup. This information can, upon scanning, be immediately transmitted to a database of the service provider (e.g. via wireless communication) or can be later communicated/entered into the database, and can be made available for follow-up by the customer/traveler, e.g., by phone, email, or web interface.

The shipping service provider can then conduct one or more security operations with respect to the containers, e.g. X-ray, chemical detection and/or other security scans as needed, and ship the containers to the destination address provided by the customer/traveler. In doing so, the service provider can acquire and maintain contracts with transportation providers and/or maintain its own transportation fleet, e.g., including air, ground, and/or water transportation vehicles. During the shipping process, the containers can be scanned one or more additional times to provide tracking data to be available to the customer/traveler. For these purposes, the packages can be scanned at intermediate locations in the shipping process, including illustratively at loading docks, airport arrivals, and potentially also destination arrival. All of this intermediate scanned information can be made available for follow-up by the customer/traveler, e.g., by phone, e-mail, or web interface. Additionally, for certain destinations, the shipment service provider can maintain contracts or understandings with common destination accommodations such as hotels, cruise ships, and the like, to allow shipment of the customer/traveler's containers and either transportation or delivery of those containers to individual rooms, cabins or other specific accommodations to be occupied by the traveler, or to be held in a central location such as a general bell desk, or a desk or room specifically contracted for shipments made by the shipping service provider.

After shipment of the containers to the final destination, and the customer's/traveler's arrival, the customer/traveler then acquires possession of the containers. This acquisition can be made in certain embodiments at a secure pickup point operated by the service company (e.g., at or near an airport, hotel, or other location), or at the final destination address provided by the customer/traveler. In certain embodiments, upon pickup of the container(s) by the customer/traveler, information can be entered into the database of the shipping service provider to confirm that the container(s) have been picked up. This may, for example, be completed by a scan of the barcode or other coding device associated with the containers by a representative of the shipping service provider personally transferring possession of the containers to the customer/traveler. It will be understood, however, that in other embodiments, the customer/traveler will acquire possession of the containers (e.g. in the customer/traveler's room or cabin) without the presence of a representative of the shipping service provider, and that in these cases no confirmation of pickup may be acquired, or the customer/traveler may confirm pickup on-line, over the phone, by email, or any other suitable means.

During the customer/traveler's stay at the destination location, the customer/traveler can unpack the containers, and in preferred forms of the containers, can disassemble the containers to their more flattened configuration for storage and later re-use. Alternatively, the traveler can be provided with or can otherwise obtain new containers to be used for shipment of belongings back to the customer/traveler's point of origin.

As a part of this service or system, the shipment service provider can send the customer/traveler a reminder of the plans for the return trip that are entered into the database of the company, and request confirmation that the dates have not changed and/or the notification of new return shipment dates if any have arisen. These reminders/confirmations can be communicated in any suitable manner, such as phone, e-mail, or web (internet) interface, and corresponding customer/traveler contact information for these communications can be maintained in the database (e.g. telephone numbers, email addresses, etc.).

For the return trip, the customer/traveler can, if needed, reassemble the containers and repack the containers for the return shipment to the origin location. In certain embodiments, the customer/traveler will apply a previously-supplied label to the containers to provide the address for the return shipment to the location of origin. Similar to the original label, this return label may contain barcoding or other coding elements which can be scanned or otherwise detected at various points in the shipment to provide identifying shipment information both for the service company and potentially also accessible to the customer/traveler to follow-up on the status of the shipment. The shipping service provider can then pick up the bags or other containers, scan them, etc., and ship the bags or other containers back to the origin destination.

Methods and systems of the invention can be applied to travelers who are passengers of commercial passenger transport operations, such as airlines, cruise lines, bus lines, train lines, and the like, or to individual-operated travel situations such as motorcycle and bicycle trips. The methods and systems may involve shipment of the passenger or other individual's containers by one or more shipment means, including ground transportation (e.g. to and from a passenger/individual's origin or destination location to a central hub for shipment such as an airport), air transportation, train transportation, etc. These shipment means may be the same as or different from the travel means to be used by the passenger or other individual. Generally, however, the shipment means contemplated herein will transport the container of the passenger/individual from the origin location to the destination location upon vehicles or vessels other than those upon which the passenger/individual travels. These shipment vessels or vehicles will beneficially be those which do not carry commercial passengers (e.g. cargo shipping vessels or vehicles). It will be understood however, that these non-commercial passenger vessels or vehicles may carry individuals to operate them or otherwise accompany the cargo being shipped.

As well, certain aspects of methods of the invention provide for "arranging for" transportation of containers of a passenger/individual. This will be understood to encompass, without limitation, situations in which an entity facilitates the transportation of the container by another entity, and/or in which an entity both plans and executes the transportation of the container.

In certain embodiments, methods, systems and products of the present invention can provide one or more of the following advantages to the customer/traveler, the airline or other commercial passenger transport entity, or the shipment service provider. It is to be understood that these are provided as alternative or additional advantages, and that any individually claimed invention herein need not satisfy any or all of these advantages.

To the customer/traveler:

no need to purchase and/or replace luggage avoid waiting at the baggage carousel no need to store traditional luggage between trips no waiting in long lines (ticket counters, security areas, rental cars, hotel shuttles, parking buses, etc.) to process or retrieve luggage virtually eliminate delayed or lost luggage (OR quick claims procedure for lost or damaged containers)

no carrying luggage through airports, during transfers, to cars or buses, to destinations no luggage limits no need to answer security questions regarding luggage to be checked through the carrier no skycaps, tipping, baggage cart costs especially advantageous for the elderly, disabled, and families with small children and groups traveling together eliminates the need for baggage searches no stress if transportation is delayed or rerouted no luggage searches at customs locations airlines, cruiselines, etc. may provide financial incentive such as rebates or discounts to passengers using this system as it should greatly reduce labor and equipment costs for baggage handling and claims Transportation Security Administration or other regulatory agency may endorse this system/method as a safer way to travel because packed belongings would not be on the same vessels as human commercial passengers the cost/benefit is favorable containers can be monitored by traveler via internet/telephone prior to travel (so traveler can solve any problems before they leave home and, if needed, pack traditional luggage to substitute for rarely lost or damaged containers)

no wasted items rejected for carry-on no need to pack the night before to leave luggage outside room or cabin (e.g. when on a cruise ship or tour) for pre-return handling relieves stress/increases travel satisfaction encourages travel by those unable to transport own luggage or manage small children and baggage To the passenger transport entity:

reduce labor and equipment costs for baggage handling reduce damaged/lost baggage claims increase passenger safety/decrease personal injury claims may create space for paid cargo not related to passengers may provide ability to reduce fares/entice passengers minimize or eliminate high-volume periods of baggage handling substantially minimize safety risks because baggage is not in same vessel as commercial passengers reduces wait times at airport security checkpoints because if passenger's belongings are already at their destinations, they will pack significantly smaller or no carry-ons and can quickly proceed through security may create "speedy" security checks for baggage-less travelers To the shipper and transporter:

create new markets for shippers utilize aspects of current electronic technology adaptable for plane, train, ship, car, bus, motorcycle and bicycle travel worldwide application is possible While various embodiments of the invention have been illustrated and described in detail in the drawings and foregoing description, the same is to be considered as illustrative and not restrictive in character, it being understood that all changes and modifications that come within the spirit of the invention are desired to be protected.

What is claimed is:

1. A method for arranging for transportation of container of an airline passenger from an origin location to a destination location via a flight taken from an origin airport to a destination airport, the origin location and destination location being distinct from the origin airport and the origin location, respectively, the method comprising:

entering origin location information, destination location information, container information, original shipping date information, and return shipping date information for the passenger into a database;

arranging for collection of the container at the origin location on the original shipping date, wherein the origin location is a residence of the passenger;

arranging for ground transport of the container to the origin airport after collection at the origin location;

arranging for the air transport of the container to the destination airport on a non-passenger flight;

arranging for ground transport of the container from the destination airport to the destination location;

arranging for collection of the container from the destination location on the return shipping date;

sending a reminder communication to the passenger providing a reminder including the return shipping date information entered in the database and an opportunity for the passenger to confirm proceeding with the return shipping date entered in the database or to provide notification of a new return shipping date;

prior to collection of the container from the destination location on the return shipping date, providing to the passenger a shipping label having an address for the origin location;

arranging for ground transport of the container from the destination location to the destination airport after collection on the return shipping date;

arranging for the air transport of the container to the origin airport from the destination airport on a non-passenger flight; and arranging for ground transport of the container from the origin airport to the origin location.

2. The method of claim 1, also comprising maintaining updated information concerning container delivery status in a database.

3. The method of claim 2, also comprising communicating the updated information to the passenger.

4. The method of claim 3, wherein said communicating comprises electronically communicating the updated information to the passenger.

5. The method of claim 4, wherein said electronically communicating is over a wireless system.

6. The method of claim 4, wherein said electronically communicating is over a communication network.

7. The method of claim 6, wherein said communication network is the Internet.

8. The method of claim 1, also comprising maintaining a Web interface for receiving the origin location information, destination location information, container information, original shipping date information, and return shipping date information from the passenger.

9. The method of claim 1, also comprising entering passenger flight information for the passenger in a database.

10. The method of claim 1, also comprising providing to the passenger a coding element for association with one or more pieces of the container.

11. The method of claim 10, wherein said coding element is a bar code.

12. The method of claim 10, wherein said providing comprises electronically communicating information for creation of said coding element.

13. The method of claim 1, wherein:

the container is a paperboard container, and wherein the paperboard container has visible indicia carried upon an external surface of the container stimulating an appearance of a luggage bag;

wherein said visible indicia include at least one image simulating the appearance of a luggage bag handle, a luggage bag latch, a luggage bag zipper, a luggage bag surface texture, and/or luggage bag seam.

14. The method of claim 1, wherein said sending a reminder communication includes sending a reminder communication to the individual by e-mail or by phone.

15. A method for arranging for shipment of container of an individual from the individual's origin location to the individual's destination location, and back, the method comprising:

entering the individual's origin location information, the individual's destination location information, the individual's container information, the individual's original shipping date information, and the individual's return shipping date information into a database;

arranging for collection of the container at the individual's origin location on the original shipping date, wherein the origin location is a residence of the individual;

arranging for transport of the container to the individual's destination location;

sending a reminder communication to the individual providing a reminder including the return shipping date information entered in the database and an opportunity for the individual to confirm proceeding with the return shipping date entered in the database or to provide notification of a new return shipping date;

arranging for collection of the container at the individual's destination location on the return shipping date;

prior to collection of the container from the destination location on the return shipping date, providing to the individual a shipping label having an address for the origin location; and arranging for transport of the container from the individual's destination location to the individual's origin location.

16. The method of claim 15, wherein said sending a reminder communication includes sending a reminder communication by email or by phone.

* * * * *